US009604239B2

(12) United States Patent
Southern et al.

(10) Patent No.: US 9,604,239 B2
(45) Date of Patent: Mar. 28, 2017

(54) SELF CLEANING WATER NOZZLE

(71) Applicant: BODYGARD LLC, Shinnston, WV (US)

(72) Inventors: Philip Southern, Shinnston, WV (US); James Seven Southern, Lumberport, WV (US)

(73) Assignee: BODYGARD LLC, Shinnston, WV (US)

( * ) Notice: Subject to any disclaimer, the term of this patent is extended or adjusted under 35 U.S.C. 154(b) by 0 days.

(21) Appl. No.: 15/147,964

(22) Filed: May 6, 2016

(65) Prior Publication Data

US 2016/0250655 A1 Sep. 1, 2016

Related U.S. Application Data

(63) Continuation-in-part of application No. 14/449,375, filed on Aug. 1, 2014, now abandoned.

(51) Int. Cl.
*B05B 15/02* (2006.01)
*B05B 1/02* (2006.01)

(52) U.S. Cl.
CPC ..... *B05B 15/0241* (2013.01); *B05B 1/02* (2013.01); *B05B 15/025* (2013.01); *B05B 15/0208* (2013.01); *B05B 15/0216* (2013.01); *B05B 15/0225* (2013.01)

(58) Field of Classification Search
CPC . B05B 15/02; B05B 15/0241; B05B 15/0208; B05B 15/0216; B05B 15/0225; E21F 5/02
USPC ..... 239/104, 106, 107, 109, 116, 436, 437, 239/451, 452; 222/149
See application file for complete search history.

(56) References Cited

U.S. PATENT DOCUMENTS 1,040,899 A * 10/1912 Dahmen ..... B05B 15/0241 239/452
2,770,498 A * 11/1956 Filliung ..... B05B 1/3006 239/109
2,803,499 A * 8/1957 Goyette ..... B05B 15/0233 239/109
4,269,355 A * 5/1981 Geberth, Jr. ..... B05B 15/0216 239/107
4,789,104 A * 12/1988 Anderson ..... B05B 1/12 239/441
5,193,746 A * 3/1993 Iwamura ..... B05B 15/0241 239/104
5,215,254 A * 6/1993 Haruch ..... B05B 15/02 239/107
5,497,946 A * 3/1996 Laidler ..... B05B 15/0241 239/106
5,634,491 A * 6/1997 Benedict ..... E03C 1/08 137/504
6,299,075 B1 * 10/2001 Koller ..... B05B 15/02 239/104

(Continued)

*Primary Examiner* — Steven J Ganey
*Assistant Examiner* — Joseph A Greenlund
(74) *Attorney, Agent, or Firm* — Clark & Brody

(57) ABSTRACT

A self-cleaning water nozzle uses specially configured nozzle halves to allow for self-cleaning, easy access to the nozzle components, and forming a hollow cone spray. The nozzle halves have grooves in side faces thereof, which when the nozzle halves are mated, the grooves form a spiral path for water to travel through the nozzle halves and form the hollow cone spray.

10 Claims, 7 Drawing Sheets

(56) References Cited

U.S. PATENT DOCUMENTS

| | | | | |
|---|---|---|---|---|
| 8,584,974 | B2 * | 11/2013 | Masloff | E21F 5/10 239/126 |
| 2004/0036346 | A1 * | 2/2004 | Johannes Klaasse | E01C 23/088 299/39.2 |
| 2016/0030963 | A1 * | 2/2016 | Southern | B05B 15/0241 239/1 |

* cited by examiner

SELF CLEANING WATER NOZZLE

This application is a Continuation in Part of U.S. Ser. No. 14/449,375 filed on Aug. 1, 2014.

FIELD OF THE INVENTION

The invention relates to a self-cleaning water nozzle, particularly a nozzle for use in environments that clog the nozzle like a coal mine.

BACKGROUND ART

The use of nozzles in the coal mining industry is well known. One application for nozzles in this industry is dust suppression during the mining operation. Nozzles are usually located at various locations on a mining machine to suppress the generation of dust.

Because of the mining operation, it is not uncommon for the nozzles to get clogged and need cleaning and repair. This cleaning requires shutting down the equipment and water flow so that the nozzle is cleaned or replaced. This shutting down operation impedes productivity and the mine operator can be subjected to fines for plugged nozzles.

Self-cleaning water nozzles are known in the art. U.S. Pat. No. 5,193,746 to Iwamura et al. is an example of one such nozzle that uses nozzle halves, a nozzle housing, and spring arrangement for the self-cleaning function. However, this design is problematic in that is requires a spring clip to keep the components in the nozzle housing. The spring clip can be dangerous when removing, easily lost, and requires the nozzle housing to be removed from the water supply line for nozzle repairs.

Accordingly, a need exists for a better self-cleaning nozzle.

SUMMARY OF THE INVENTION

An object of the invention is to provide an improved self-cleaning nozzle, particularly one for use in mining operations, including the actual mining, belt transfer points, and ratio belt feeders.

Another object of the invention is a method of mining using a plurality of nozzle sprays, wherein the inventive nozzle is used as part of dust suppression.

Other objects and advantages of the invention will become apparent from the following description.

One aspect of the invention is a self-cleaning water nozzle. The nozzle comprises a nozzle housing having an inlet to receive water and an outlet to discharge water. An inside of the nozzle housing has a pair of opposing grooves extending along a length of the inside of the nozzle housing. An outlet cap is provided that is removably attachable to the outlet, preferably using threads.

A seal, preferably an O-ring, is positioned between an inside of the outlet cap and the outlet of the nozzle housing.

The nozzle assembly further comprises nozzle halves, the nozzle halves when put together form a nozzle opening at one end of the nozzle assembly to allow for discharge of the water. The nozzle halves are sized to fit within the nozzle housing, each half include a flange, a portion of each flange engaging one of the opposing grooves to prevent the nozzle assembly from rotating in the nozzle housing. A spring sized to surround the nozzle assembly is positioned between an end face of the outlet cap and faces of the flanges of the halves. A washer is positioned in the nozzle housing between the inlet and the nozzle assembly, the washer having first and second opposing surfaces and a pair of peripheral portions engaging the grooves in the nozzle housing. The first opposing surface includes a pair of protrusions positioned on the washer, the pair of protrusions adapted to contact a bottom portion of each of the halves to allow the halves to separate and enlarge a nozzle assembly opening to free debris caught between the nozzle halves. The washer opening also allows for water to pass through the washer from the nozzle housing inlet to the nozzle assembly.

The spring is sized so that when water is applied to the second opposing surface at a predetermined pressure or less, the spring expands to move the nozzle halves away from the outlet and contact the pair of protrusions for the separation of the halves and nozzle cleaning.

While the spring can be designed to expand and compress based on various water pressures that the nozzle would see, one example of a threshold pressure would be 25 psi. This pressure or less would allow the spring to expand for self-cleaning. A pressure higher than 25 psi would compress the spring and bring the nozzle halves together for water spraying.

The nozzle assembly can be held together by the use of a resilient washer. The nozzle assembly can include a groove at an end opposite the nozzle opening, the groove sized to receive the resilient washer to keep the nozzle halves together.

Each flange of each nozzle half can include a rib, whereby an upper surface of the rib has the face to receive one end of the spring. The outlet cap can have a tapered inside wall to allow for separation of the halves.

The invention also is an improvement in the spraying of water or other fluid using nozzles. Using the inventive nozzles and their self-cleaning function allows for an improved water spraying operation. Operation of the water sprays can include reducing the pressure of the water to allow for self-cleaning with resumption of the operating pressure allow the water sprays to perform their intended function. The water sprays are particularly useful in environments where nozzle clogging is a problem, e.g., coal mine environments, and particularly dust suppression water sprays on mining machines.

Another embodiment of the invention uses a modified housing and spray nozzle halves configuration and does not require the need for a washer that the nozzle halves rest on when the nozzle halves are in the housing and provides a hollow cone spray pattern.

DESCRIPTION OF THE INVENTION

The self-cleaning water nozzle of the invention is ideally suited for use on mining machines, particularly those used in the coal mining industries. The mining machines generate a lot of dust and this dust must be suppressed to meet the proper government regulations. Typically, the mining machine uses cooling water in two ways. One is to cool the electric controllers plus the electric motors (heat is the enemy of both). A second function involves the water sprays. The water used to cool the components on the mining machine is channeled into the spray blocks and thru the spray nozzles. The electric boxes, motors and spray blocks all are made of mild steel and tend to rust. In most cases, the rust is what plugs up the nozzles along with some water from their internal sumps which historically are full of foreign material.

The invention provides an efficient way to self-clean the nozzles in combination with an improved way for the nozzles to function in a self-cleaning way and ease the removal of nozzle components, if such is necessary.

Figure 1:
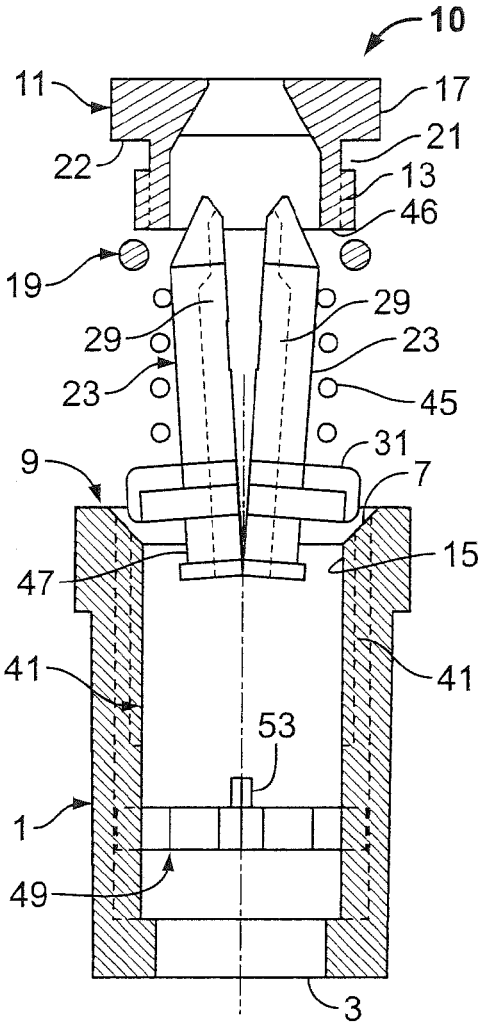
FIG. 1 shows an exploded view of the nozzle of the invention.
Figure 2:
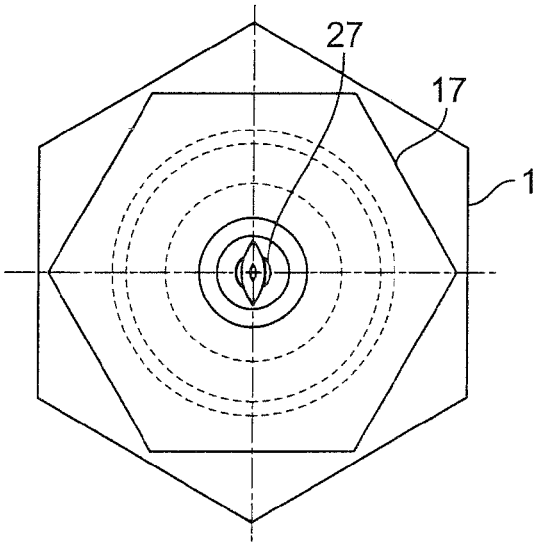
FIG. 2 shows a top view of the nozzle.

Referring to FIGS. 1 and 2 initially, one embodiment of the invention is designated by the reference numeral 10 and includes a nozzle housing 1 having an inlet 3 and an outlet 5.

The nozzle outlet 5 has a chamfer 7 to enhance sealing. The inlet 3 is removably attachable to a water supply line (not shown), preferably using threads.

A threaded outlet cap 11 is removably attachable to the nozzle housing 1. A preferred mode is through the use of threads, wherein the cap 11 is threaded at 13 and complementary threads 15 are located inside of the nozzle housing 1. The outlet cap is annular in shape with a hex nut end 17, see FIG. 2, to facilitate tightening of the cap 11 to the housing 1.

The housing 11 is cylindrical on its inside to facilitate its attachment to the cap and the water supply line. The outer shape is preferably also hex-shaped to facilitate connection to the water supply line.

A seal, preferably in the form of an O-ring 19 is provided. The seal sits in a groove 21 forming between an underside 22 of the hex nut end 17 and the threads 13. The O-ring 19 also contacts the chamfer 7 at the outlet 9 to prevent leakage of water from the nozzle housing.

The nozzle 10 also includes a pair of nozzle halves, each designated by reference numeral 23. The nozzle halves are configured to join together to form a nozzle assembly, with the nozzle spray tip 27 forming the spray orifice for the nozzle. The nozzle halves each have a recess 29 extending along a length thereof, the recess forming a passage when the nozzle halves mate together for water flow from the end of the nozzle halves to the spray tip 27.

Figure 3A:
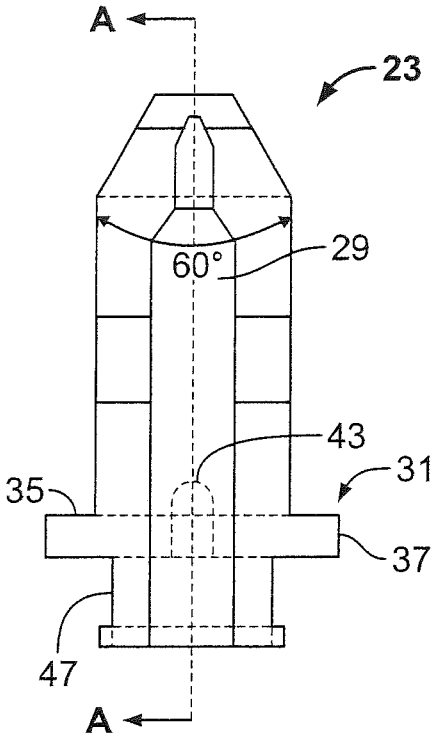
FIGS. 3*a*-3*d* show different views of one of the nozzle halves shown in FIG. 1.
Figure 3B:
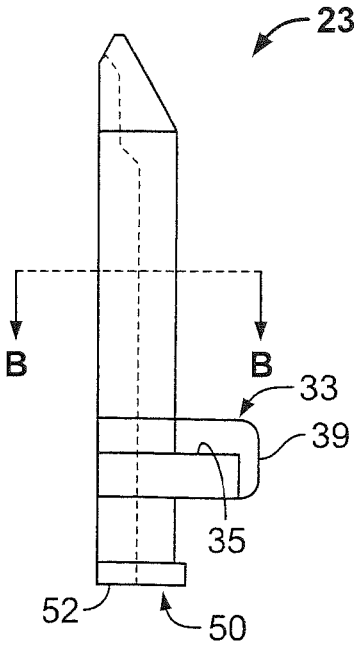
Figure 3C:
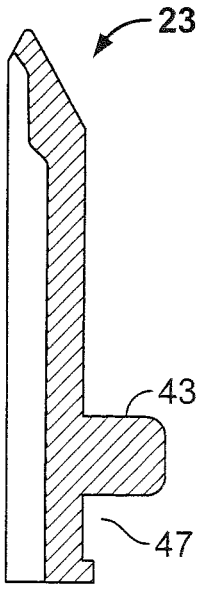
Figure 3D:
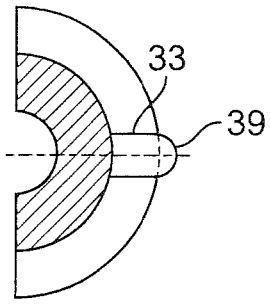

Each nozzle half has a flange 31, which serves two functions. One is an anti-rotation feature and the other is to assist in the self-cleaning function of the nozzle assembly. Referring now to FIGS. 3*a*-3*d*, the nozzle halves 23 are shown in more detail. FIG. 3*a* shows a side view of the half with FIG. 3*b* showing a side view of the nozzle shown in FIG. 3*a*. FIG. 3*c* shows a sectional view along the lines A-A of FIG. 3*a* and FIG. 3*d* is a sectional view along the lines B-B of FIG. 3*b*.

The flange 31 has a rib 33, see FIG. 3*d* in particular, that extends from the surface 35 of the flange. The rib 33 also extends beyond the peripheral edge 37 of the flange 31 to form a protrusion 39, see FIGS. 3*b* and 3*d*. The protrusion 39 extends along the peripheral edge 37 of the flange 31.

The protrusion 39 on each half is an anti-rotation feature, wherein the protrusion 39 engages a pair of opposing grooves 41, see FIG. 1, that run along a length of an inside surface of the housing 1. With a protrusions 39 engaged in each groove 41, the nozzle halves are rotationally fixed with respect to the housing and cannot rotate.

The rib 33 also has an upper face 43, see FIG. 3*c*, that acts as a support for a spring 45 positioned inside the housing and between an underside 46 of the cap 11 and face 43. The spring 45 is designed so that it expands when a certain water pressure is applied to an underside of the nozzle halves and is compressed when the water pressure exceeds that threshold and this is explained with respect to FIGS. 5 and 7 below.

Each nozzle half 23 has a groove 47, which is designed to receive a resilient washer 48, or the like to keep the halves 23 together. The washer 48 is shown in FIG. 1 and has a resiliency to allow the halves 23 to separate for self-cleaning but keep the halves 23 together. The washer is optional though since the engagement between the grooves 41 and protrusions 39 could also keep the halves 23 together sufficiently for spraying.

Each nozzle half 50 also uses a portion of the bottom thereof to assist in the self-cleaning. Referring to FIG. 3*b*, the half has a bottom surface 50 with a portion 52 of the bottom surface 52 functioning to assist in self-cleaning as described below.

Figure 4A:
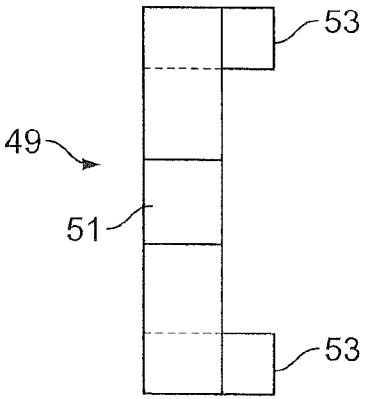
FIGS. 4*a* and 4*b* shows a side and top view of a washer used in the nozzle of FIG. 1.
Figure 4B:
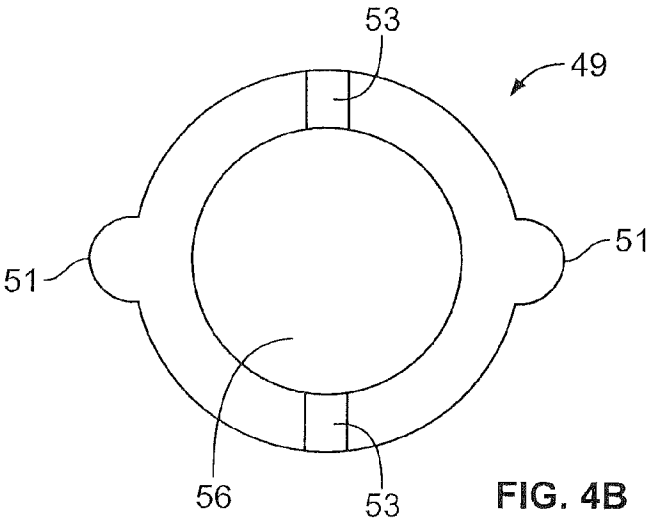

Another washer 49 is provided and designed to fit within the housing 1 like the nozzle halves 23. Referring to FIGS. 4*a* and 4*b*, the washer has protrusions 51 that are analogous to the protrusions 39 of the nozzle halves 23. The protrusions 51 are also sized to engage the grooves 41 in the housing 1 so that the washer is fixed in place against rotation.

The washer 49 also has a pair of raised protrusions 53. The raised protrusions are spaced from the protrusions 51. More particularly, the protrusions 53 are displaced 90 degrees from the line intersecting with the protrusions 51. The protrusions 53 function to assist separation and opening of the nozzle halves 23 for the self-cleaning function in concert with the spring, water pressure, grooves 41, etc. The washer has an opening 56, which permits water to flow from the inlet 3 of the housing 1 for water spray purposes.

Figure 5:
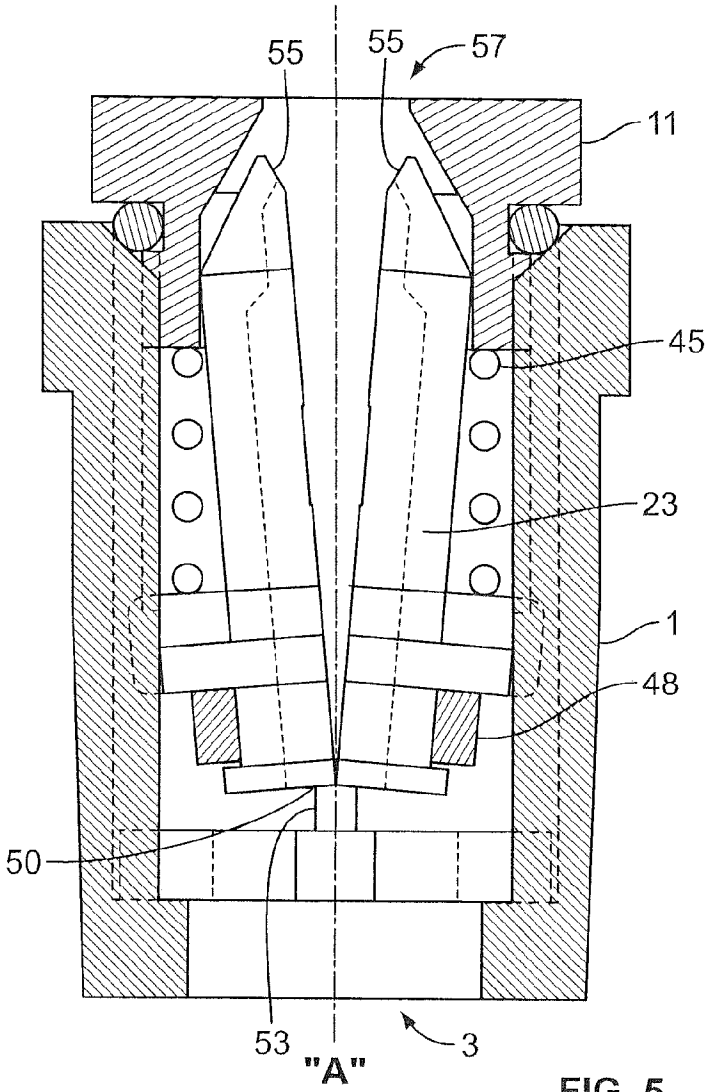
FIG. 5 shows the nozzle of FIG. 1 in a self-cleaning mode.
Figure 6:
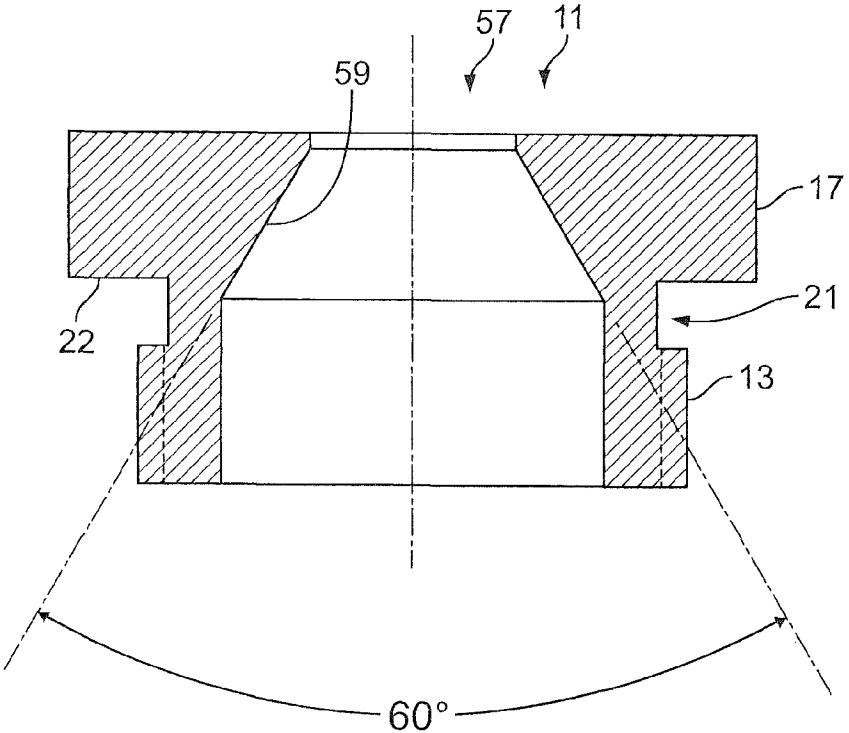
FIG. 6 shows a sectional view of the outlet cap of the nozzle of FIG. 1.

Referring now to FIGS. 5 and 6, the self-cleaning mode of the inventive nozzle is shown. That is, the spring 45 is shown in the expanded state wherein the water pressure is at a level that allows the spring to expand. Expansion of the spring moves the halves 23 toward the inlet 3 of the housing 1. The nozzle halves move in unison, with the protrusions 39 running in the grooves 41 and keeping the halves in line with each other during movement. The protrusions 39 can have any shape but a curved shape (a particular radius) as shown in FIG. 3*d* is preferred. The groove 41 in the housing 1 would also have a complementary curved shape as well.

During movement of the halves 23, the bottom surface portion 52 of each half 23 contacts the protrusions 53 on the washer 49. Since only a portion 52 of the bottom surface 52 of the halves 23 rests against the washer 49 and the force of the spring 45 is at an outer peripheral edge of the halves on the ribs 33, the halves pivot about the line A at the point where the bottom portion 52 and protrusions 53 contact. The movement of the halves 23 toward the end 3 displaces the tip ends 55 of the nozzle halves 23 from an opening 57 in the cap 11.

Referring to FIG. 6, the cap 11 is configured internally with a tapered wall 59 that enlarges the inside of the cap 11 with respect to the opening 57. This leaves room for the halves 23 to separate and permits the existing water pressure to flush out any debris that may have be caught in the spray tip 27 or in the passageway formed when the nozzle halves 23 are mated together.

Figure 7:
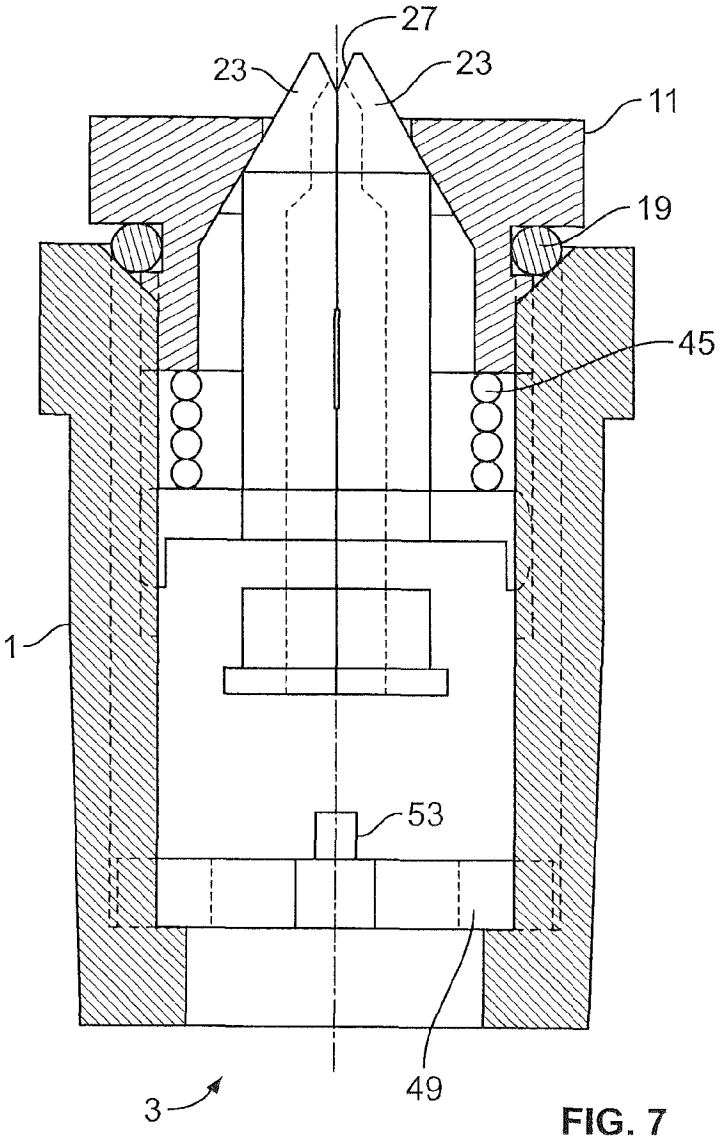
FIG. 7 shows the nozzle of FIG. 1 in the operational mode.

Once the water pressure exceeds the level that permits the spring 45 to expand, the spring 45 is compressed as shown in FIG. 7. Here, the nozzle halves 23 are moved toward the cap opening 57 and merge together by virtue of the tapered wall 59 on the inside of the nozzle cap 11. The nozzle halves 23 are guided again by the engagement between the grooves 41 and protrusions 53 on the flanges 31 of the halves 23. With the spring 45 compressed, the spray tip 27 is formed again for water spraying.

One advantage of the invention is that the cap 11 is easily removed if the self-cleaning function does not completely clean the nozzle or if the nozzle halves, washers, and/or spring are in need of repair or replacement. The housing with its attachment to a water supply line does not have to be removed. Also, the danger of using a spring clip to retain the components as is the case in the prior art is eliminated in the inventive design. Further, the washer and use of the protrusions provides a solid arrangement to obtain the necessary pivoting action for the halves to open them for cleaning purposes.

While an O-ring seal is employed, other seals can be used. Also, while the protrusions 53 and 51 are displaced by 90 degrees from each other, other displacements could be used. The key is that the protrusions or other raised structures on the washer 49 are situated so that they engage the bottom of the halves 23 to create a pivot point to allow for opening of the halves for the self-cleaning operation.

While the spring could be sized to expand at a variety of pressures, from no pressure to pressure lower than the operating pressure of the nozzles, one example is a threshold of 25 psi. If the pressure is 25 psi or below, the nozzle would self-clean. In this way, an operator could periodically reduce the water pressure for the nozzles to the point that they would self-clean and once a period of time is given for self-cleaning, the water pressure could be increased to a normal pressure for dust suppression.

FIGS. 8-14 show another embodiment of the spray nozzle assembly of the invention and it is designated by reference numeral 60. This nozzle assembly also provides a hollow cone spray pattern as well as a simplified design than the embodiment of FIGS. 1-7. One of the differences between the FIG. 1 and FIG. 8 embodiment is the lack of a washer in the FIG. 8 embodiment. The nozzle halves in the FIG. 8 embodiment are configured themselves to facilitate the opening of the nozzle halves for cleaning purposes and do not require a washer. Also, the nozzle halves are specially configured on an inside face thereof to form a spiral path when the nozzle halves are mated to form the hollow cone spray pattern of water and the nozzle is used for spraying purposes.

Figure 8:
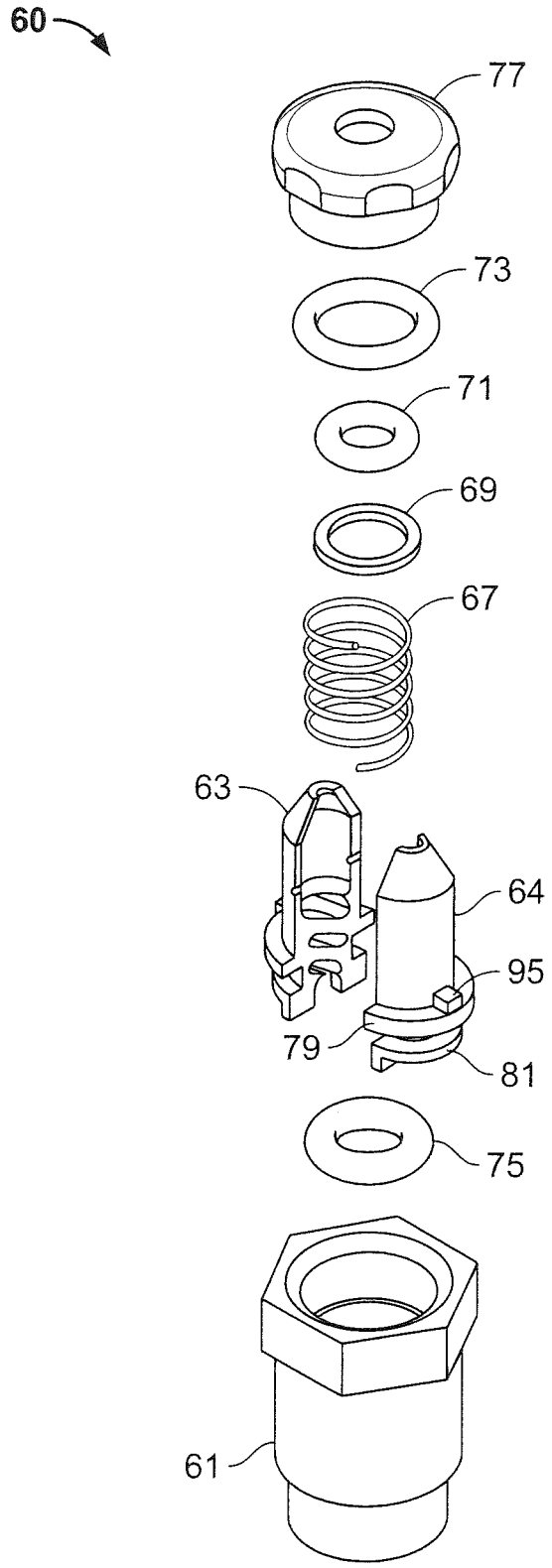
FIG. 8 shows an exploded view of another embodiment of the invention.

FIG. 8 shows an exploded view of the nozzle assembly 60 that includes a nozzle housing 61, a first nozzle half 63, and a second nozzle half 64, a spring 67, an o-ring shim 69, o-rings 71, 73, and 75, and a hex head nut or nozzle cap 77.

Figure 9:
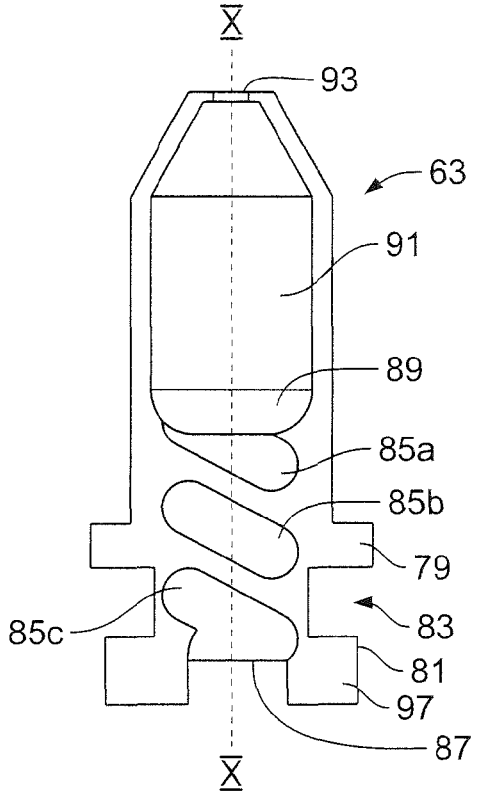
FIG. 9 shows a side view of a first nozzle half of the embodiment of FIG. 8.
Figure 10:
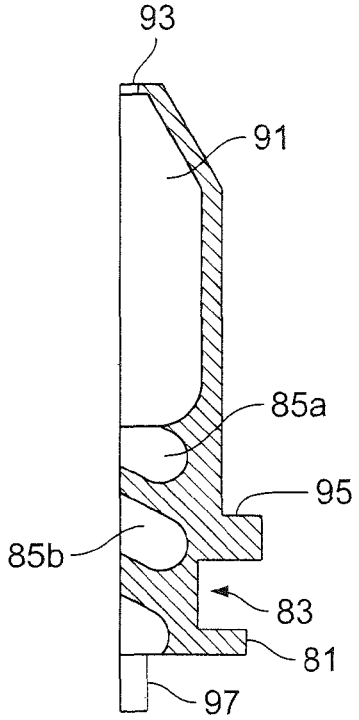
FIG. 10 shows a sectional view along the line X-X of FIG. 9.
Figure 11:
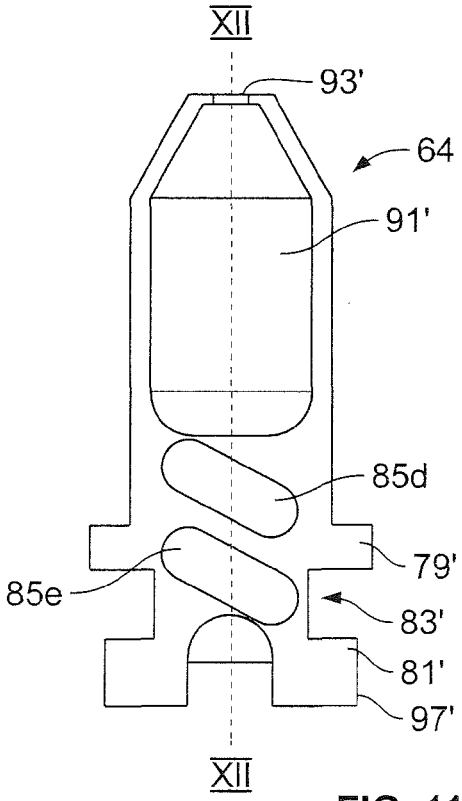
FIG. 11 shows a side view of a second nozzle half of the embodiment of FIG. 8.
Figure 12:
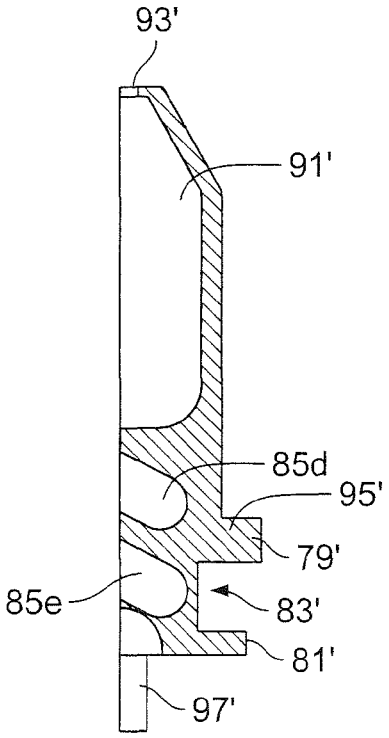
FIG. 12 shows a sectional view along the line XII-XII of FIG. 11.

Referring to FIG. 9, first nozzle half 63 includes flanges 79 and 81, the flanges forming a semicircular groove 83.

The half 64 has corresponding flanges 79' and 81' and semicircular groove 83' similar to half 63. The o-ring 75 is designed to fit into a circular groove that is forming when the two semicircular grooves are mated together when the halves 63 and 64 are mated. The o-ring 75 keeps the nozzle halves 63 together similar to that described for FIGS. 1-7.

Each of the halves 63 and 64 has grooves formed in their respective half bodies. Half 63 has grooves 85*a*, 85*b*, and 85*c*. The half 64 also has grooves 85*d* and 85*e*.

The grooves 85*a*-85*e* form a spiral path when the halves 63 and 64 are mated. This spiral path has an inlet 87 in half 63 and an outlet 89, which opens into a recess 91 in the half 63. The grooves 85*d* and 85*e* are not in communication with either an inlet end or the recess 91' formed in the half 64 and outlet end 93'. When the two halves 63 and 64 are mated together, the grooves link with each other to form a continuous spiral path for water to pass from an inlet end 87 of the half 63 to an outlet end 93, 93' of the mated halves 63 and 64 to form the hollow cone spray pattern.

Each flange 79, 79' also include a rib 95, 95' with the ribs diametrically opposed when the two halves 63 and 64 are mated together. Each rib 95, 95' forms a seat for the spring 67 to rest on, similar to the arrangement of the ribs 33 in the FIG. 1 embodiment. The spring 67 surrounds the halves 63 and 64 and is situated in a space formed by the mated halves 63 and 64 and the housing 61 and held in place with the nozzle cap 77.

Each of the halves 63 and 64 also include a bottom rib 97 and 97'. The bottom ribs 97 and 97' are positioned 90 degrees from the ribs 95, 95'.

Figure 13:
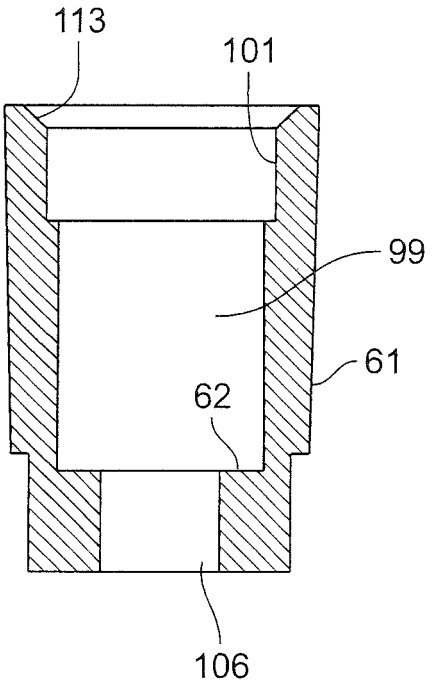
FIG. 13 shows a sectional view of the nozzle cap shown in FIG. 8.

Unlike the nozzle housing in the FIG. 1 embodiment, the nozzle housing 61, see FIG. 13, and halves 63 and 64 and nozzle housing do not have a need for the anti-rotation feature in the FIG. 1 embodiment as the spray pattern is a hollow cone type. Therefore, the inside 99 of the nozzle housing 61 is generally cylindrical and smooth in shape where the spring 67 and halves 63 and 64 reside. The nozzle housing 61 does have a threaded section 101 to threadably engage the threaded section 103 on the nozzle cap 77, see FIG. 14. The nozzle cap 77 is constructed similar to the outlet cap of the FIG. 1 embodiment with a groove 105 to receive the o-ring 73 to seal the assembly when the nozzle cap 77 is threadably attached to the nozzle housing 61.

When all of the components of the nozzle 60 are assembled, the spring 67 is biased against the two ribs 95, 95', thus causing the two halves 63 and 64 to pivot where the bottom ribs 97, 97' contact the surface 62 of the nozzle housing 61, causing the outlet ends 93, 93' to open up for self cleaning. As with the FIG. 1 embodiment, this self cleaning is based on an insufficient water pressure to overcome the spring force.

More specifically, when no water is applied to the nozzle, the spring bias of the spring 67 moves the nozzle halves 63 and 64 toward the inlet end 106 of the nozzle housing 61. The movement of the nozzle halves 63 and 64 toward the inlet end 106 of the nozzle housing causes the nozzle halves 63 and 64 to separate at the outlet ends 93, 93' thereof by action of the spring 67 on the ribs 95, 95' and ribs 97, 97' on the nozzle housing surface 62. This separation opens the outlet ends of the nozzle halves to allow a self cleaning of the nozzle. When water is supplied to the nozzle, the water pressure will eventually overcome the spring bias and moves the nozzles halves toward the outlet end 107 of the nozzle cap 77 to produce the hollow cone spray, where the nozzle cap, O-ring 71, and shim 69 are configured to force the ends of the halves together for spraying. Shutting off the water to the nozzle lets the spring bias take over to open the nozzle halves until water is again supplied to the nozzle.

Figure 14:
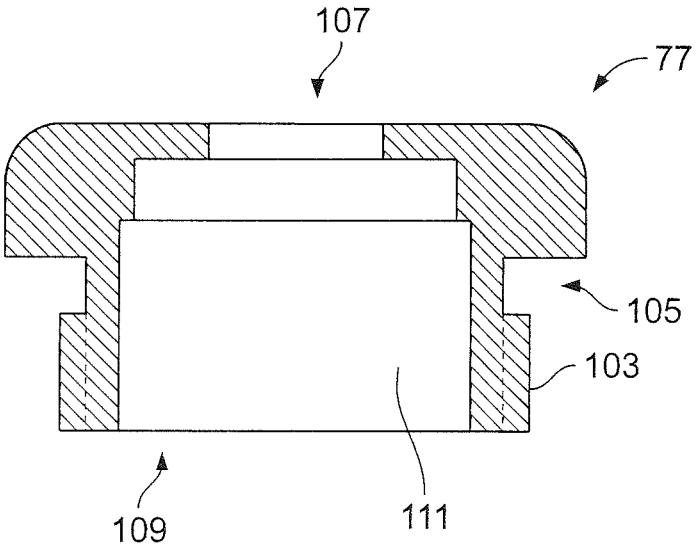
FIG. 14 shows a sectional view of the nozzle housing shown in FIG. 8.

The nozzle cap 77 is shown in FIG. 14. The nozzle cap 77 has an inlet end 109 along with the outlet end 107. The inlet end 109 has a smaller diameter than the outlet end and is designed to threadably attach via threaded surface 103 to an inner threaded surface 101 of the nozzle housing 61.

The nozzle cap 77 has a cavity 111 that receives the o-ring 71. The o-ring 71 is held in place by the o-ring shim 69. The purpose of the o-ring 71 and shim 69 is to better seat and clamp the tips of the nozzle halves 63 in the nozzle cap 77. This means that the spray is more uniform and it is ensured that water exits the opening formed at the end of the nozzle halves and not leak where surfaces of the nozzle halves mate adjacent to the tip opening. This replaces the angled configuration of the outlet cap 11 in the FIG. 1 embodiment.

The nozzle housing 61 includes a chamfered surface 113 to facilitate sealing with the o-ring 73 positioned in the groove 105 formed in nozzle cap 77, see FIGS. 13 and 14.

The advantage of the FIG. 8 embodiment is that it can produce a hollow cone spray, which the FIG. 1 embodiment is not capable of doing. More particularly, the FIG. 1 embodiment produced a flat spray by virtue of the nozzle halves and fixed orientation of the nozzle halves in the housing due to the anti-rotation feature. By the fact that the nozzle halves and grooves therein form a hollow cone spray, there is no need to have the anti-rotation feature of the FIG. 1 embodiment. Also, the FIG. 8 embodiment does not require the washer or the complicated inner surface configuration of the nozzle housing or nozzle halves to provide the anti-rotation feature of the FIG. 1 embodiment. The nozzle cap configuration in the FIG. 8 embodiment is also made simpler.

While the self-cleaning nozzle can be used where any water spray is desired, it is particularly useful in harsh environments such as a coal mine, where the nozzles can frequently clog. Any method that employs a nozzle for spraying of water can be improved by use of the inventive self-cleaning nozzles of the invention. These methods would include water sprays used in coal mining environments, e.g., sprays on a mining machine.

As such, an invention has been disclosed in terms of preferred embodiments thereof which fulfills each and every one of the objects of the present invention as set forth above and provides a new and improved self-cleaning nozzle and method of use.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. A self-cleaning water nozzle comprising:

a) a nozzle housing having an inlet to receive water, an outlet to discharge water, and a housing chamber;

b) a nozzle cap removably attachable to the outlet;

c) a seal positioned between an inside of the outlet cap and the outlet of the nozzle housing;

d) a nozzle assembly comprising a pair of nozzle halves, each of the nozzle halves having a plurality of grooves in a side face thereof, the grooves forming a spiral path when the nozzle halves are put together to form mated nozzle halves, the spiral path having an inlet and an outlet, the inlet in communication with an inlet of the nozzle housing, the outlet in communication with a chamber formed by the mated nozzle halves, the mated nozzle halves forming a nozzle opening at one end of the nozzle assembly to allow for discharge of the water, the nozzle halves sized to fit within the nozzle housing, each half including a flange and a bottom rib;

e) a spring sized to surround the nozzle assembly and be positioned between an end face of the nozzle cap and faces of the flanges of the nozzle halves;

f) wherein the spring is sized so that when water is applied to a bottom of the nozzle halves at a predetermined pressure or less, the spring expands to move the nozzle halves away from the outlet, the spring contact against the faces of the flanges and contact of the bottom ribs with a bottom surface of the housing chamber causing separation of the nozzle halves for nozzle cleaning.

2. The nozzle of claim 1, wherein the seal is an O-ring.

3. The nozzle of claim 1, wherein the spring is sized to expand at water pressures of 25 psi or less.

4. The nozzle of claim 1, further comprising a seal and seal shim positioned in the nozzle cap to interface with ends of the mated nozzle halves.

5. The nozzle of claim 1, wherein each flange has a rib, and an upper surface of the rib has the face to receive one end of the spring.

6. The nozzle of claim 1, wherein the housing chamber has a smooth inner cylindrical wall portion to receive the nozzle halves.

7. The nozzle of claim 1, wherein the outlet cap is threadably attached to the nozzle housing.

8. In a method of providing a spray of water using a nozzle, the improvement comprising using one or more of the self-cleaning water nozzle assembly of claim 1 to form a hollow cone spray pattern of water.

9. The method of claim 8, wherein the spray of water is provided in a coal mine environment.

10. The method of claim 9, wherein the spray of water is provided on a mining machine in the coal mine environment.

* * * * *